US007695342B1

(12) United States Patent
Cameron et al.

(10) Patent No.: US 7,695,342 B1
(45) Date of Patent: Apr. 13, 2010

(54) REALISTIC GRASPING AND STANDING MOVEMENTS IN MECHANICAL TOYS

(75) Inventors: Don Cameron, Riverside, RI (US); Richard J Maddocks, Barrington, RI (US); Eduardo J Rodriguez, Tiverton, RI (US)

(73) Assignee: Hasbro, Inc., Pawtucket, RI (US)

( * ) Notice: Subject to any disclaimer, the term of this patent is extended or adjusted under 35 U.S.C. 154(b) by 212 days.

(21) Appl. No.: 11/944,156

(22) Filed: Nov. 21, 2007

(51) Int. Cl.
*A63H 3/20* (2006.01)

(52) U.S. Cl. ..... 446/330; 446/390

(58) Field of Classification Search ..... 446/330; 74/53, 54, 567, 490.05; 294/116
See application file for complete search history.

(56) References Cited

U.S. PATENT DOCUMENTS 4,244,138 A * 1/1981 Holahan et al. ..... 446/301
4,579,543 A * 4/1986 Renger et al. ..... 446/334
4,666,419 A 5/1987 Droller et al.
5,378,188 A * 1/1995 Clark ..... 446/330
5,964,638 A * 10/1999 Emerson ..... 446/339
6,926,580 B1 * 8/2005 Wang ..... 446/299

* cited by examiner

*Primary Examiner*—Gene Kim
*Assistant Examiner*—Urszula M Cegielnik
(74) *Attorney, Agent, or Firm*—Perry Hoffman

(57) ABSTRACT

An electro-mechanical character or figure such as a toy animal that can replicate realistic grasping and standing positions of animals and other creatures while they are supported on a surface as well as when they are perched on a bar or other supporting elements by coordinating the positioning and movement of specific body parts. To this end it is regarded that through observation of live animals, the mechanism can be seen to exhibit a grasping action around a perch to achieve a fully supported free-standing position. Birds in particular can readily be shown to exhibit a grasping action in their talons. The grasping members and support members include a front portion and a rear portion that facilitate a pivoting action on a center portion to a closed position when grasping and an open position when standing.

20 Claims, 7 Drawing Sheets

REALISTIC GRASPING AND STANDING MOVEMENTS IN MECHANICAL TOYS

BACKGROUND OF THE INVENTION

1. Field of the Invention

The present invention relates to mechanical toys with movable body parts. More particularly, the invention relates to a realistic electro-mechanical toy that can replicate lifelike grasping and standing positions of animals and other creatures while they are supported by bar or perch as well as when they are free-standing on horizontal surfaces by coordinating the positioning and movement of specific body parts.

2. Description of the Related Art

The toy industry has seen an evolution of technology in recent years which has coincided with a consumer demand for more and more realistic toys and games. Several sectors of the toy industry have used technological advancements to make toys and games more realistic and lifelike. For example, video games are more realistic and lifelike than anyone could have imagined, and dolls can now speak, walk, and even roller skate. As technology continues to improve, consumers want toys that have more capabilities or that are more realistic.

Consumer driven evolutions in the industry is found in toys embodied as creatures, animals, dolls and various other life forms real or imagined. To provide a more realistic and interactive doll or toy, the toy industry has generally employed relatively inexpensive motors and linkage assemblies to provide realistic mechanical dolls and toys. However, although such dolls may provide some realistic movable body parts, the dolls do not exhibit realistic limb movements and postures while supported through grasping a bar or perch or free standing positions on a horizontal surface.

Recent attempts to increase the realism of a doll or toys' grasping ability focus on either support through grasping a bar or perch or a free-standing position on a horizontal surface. An appendage system disclosed in U.S. Pat. No. 5,964,638 entitled "Manually Activated Figure Toy" to Emerson et al., issued Oct. 12, 1999, incorporates a bird with a trigger mechanism. The bird's talons are disclosed in the '638 patent as initially in a closed position. When the trigger is pulled, the talons enter an open position. If the bird is put onto a bar and the trigger released, the closing talons will hold the bird onto the bar.

Another attempt to simulate a doll or toy support through grasping a bar or perch using an appendage system is disclosed in U.S. Pat. No. 4,244,138 entitled "Animated Action Toy Bird" to Holahan et al., issued Jan. 1, 1981, which incorporates a bird with grasping abilities. The '138 patent grasping ability occurs in two ways. One, by pulling a plunger on the back of the bird, the talons of the bird can be opened and closed around a bar or perch. The second, a button on the palm of the talon can be depressed causing the talons to enter a closed grasping position, preventing the bird from obtaining a free-standing position.

Other attempts to simulate a doll or toy with contracting appendages focus on a doll in a free-standing position that when manually activated has appendages that contract in a grasping manner as is disclosed in U.S. Pat. No. 4,666,419 entitled "Figure Toy With Gripping Legs Assembly" to Droller et al., issued May 19, 1987, incorporates a doll, capable of a free-standing position. Necessary to the '419 is a button located on the dorsal side of the figure, when compressed, the appendages contract inward. By releasing the button, the appendages are return to their original positions.

Another attempt to simulate a doll or toy in a free-standing position that when manually activated has appendages that contract in a grasping manner is disclosed in U.S. Pat. No. 5,378,188 entitled "Tendon and Spring for Toy Actuation" to Clark et al., issued Jan. 3, 1995. The '188 patent incorporates a doll, capable of a free-standing position. When the doll's torso is compressed, the upper appendages curl inward and the lower appendages rise upwards, removing the dolls free-standing ability. By releasing the doll, the upper and lower appendages are motivated to their original positions.

A need exists for a limb or appendage system to coordinate realistic limb movements and postures where the doll or toy is supported by grasping a bar or perch or where the doll or toy is free-standing on a horizontal surface. Moreover, a need exists for a doll or toy that can be readily transferred from a grasping position to a free-standing position while maintaining realistic limb movements and postures.

SUMMARY OF THE INVENTION

The present invention solves the aforementioned needs by exhibiting realistic limb movements and postures in a doll or toy figure, while the figure is either supported by grasping a bar or perch supporting element, or while alternately in a free-standing position on a generally horizontal surface. In a described embodiment the figure is provided as a parrot. The described embodiments are further capable of being readily transferred from the grasping position to the free-standing position while preserving realistic limb movements and postures.

Briefly summarized, the present invention relates to a mechanism for supporting a figure having a torso and one or more appendages through one or more grasping members. Each grasping member includes a front portion, a center portion, and a rear portion capable of a pivoting action through the use of a cam. A supporting element such as a perch in a described embodiment may be provided including a protrusion portion that may be received by the center portion at an aperture therein, with a base portion operable through a biased securing device. The grasping member may be alternately configured for use as a support member being capable of facilitating a free-standing position through the use of a front pivoting connection and a rear pivoting connection to the respective front and rear portions at the center portion.

DETAILED DESCRIPTION OF THE PREFERRED EMBODIMENTS

Figure 1:
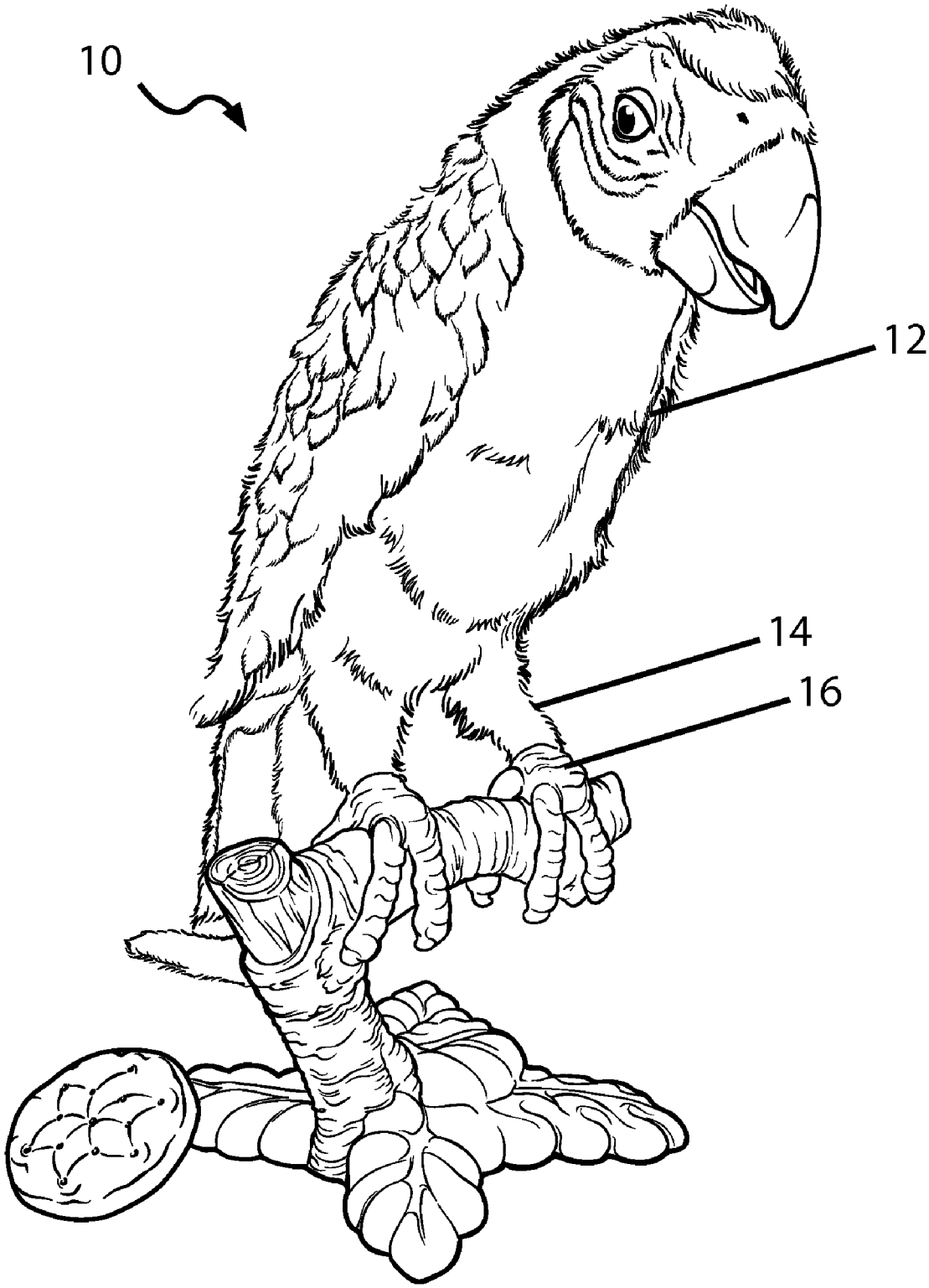
FIG. 1 is a perspective view of the figure according to an embodiment of the present invention illustrating its grasping members in their closed positions.

An electro-mechanical character or figure such as a toy animal, generally shown in FIG. 1 as reference numeral 10, provides realistic limbs which emulate movements and positions of actual animals and other creatures both while they are being supported on a surface as well as when they are perched on a bar or other supporting elements. To this end it is regarded that through observation of live animals, the mechanism can be seen to exhibit a grasping action around a perch to achieve a fully supported free-standing position. The FIG. 10 of the present embodiment has a torso 12 and one or more appendages 14. Attached to the appendages 14 is a grasping member 16, which emulates a grasping or closing action by pivoting when the FIG. 10 is set on a support as discussed further below with reference to supporting element 28. The FIG. 10 likewise emulates a standing position or opening of the grasping member 16 operable with the first support member 34 by a pivoting action of the grasping member 16 for use in supporting the FIG. 10 when set on a generally horizontal surface 32. In an alternate embodiment, e.g., a monkey, the FIG. 10 could be hung from a surface. The FIG. 10 may look like a variety of animals and creatures, real or imagined, with any number of movable limbs, hands, fins, wings, or feet. In the present described embodiment, the FIG. 10 takes on the shape of a bird and grasping member 16 and first support member 34 are shaped like talons.

Figure 2:
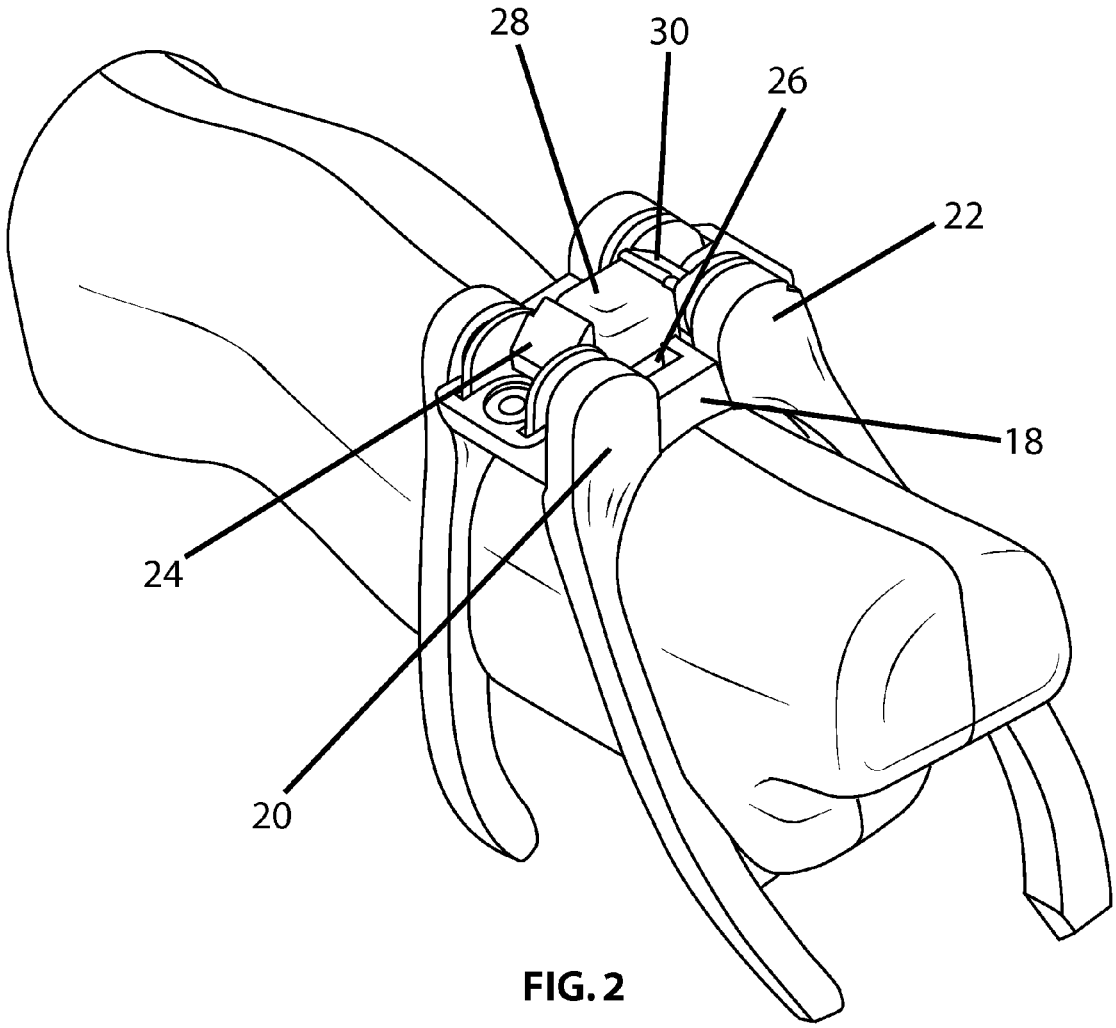
FIG. 2 is a perspective view illustrating a grasping member embodiment in the closed position in accordance with the present invention.
Figure 3:
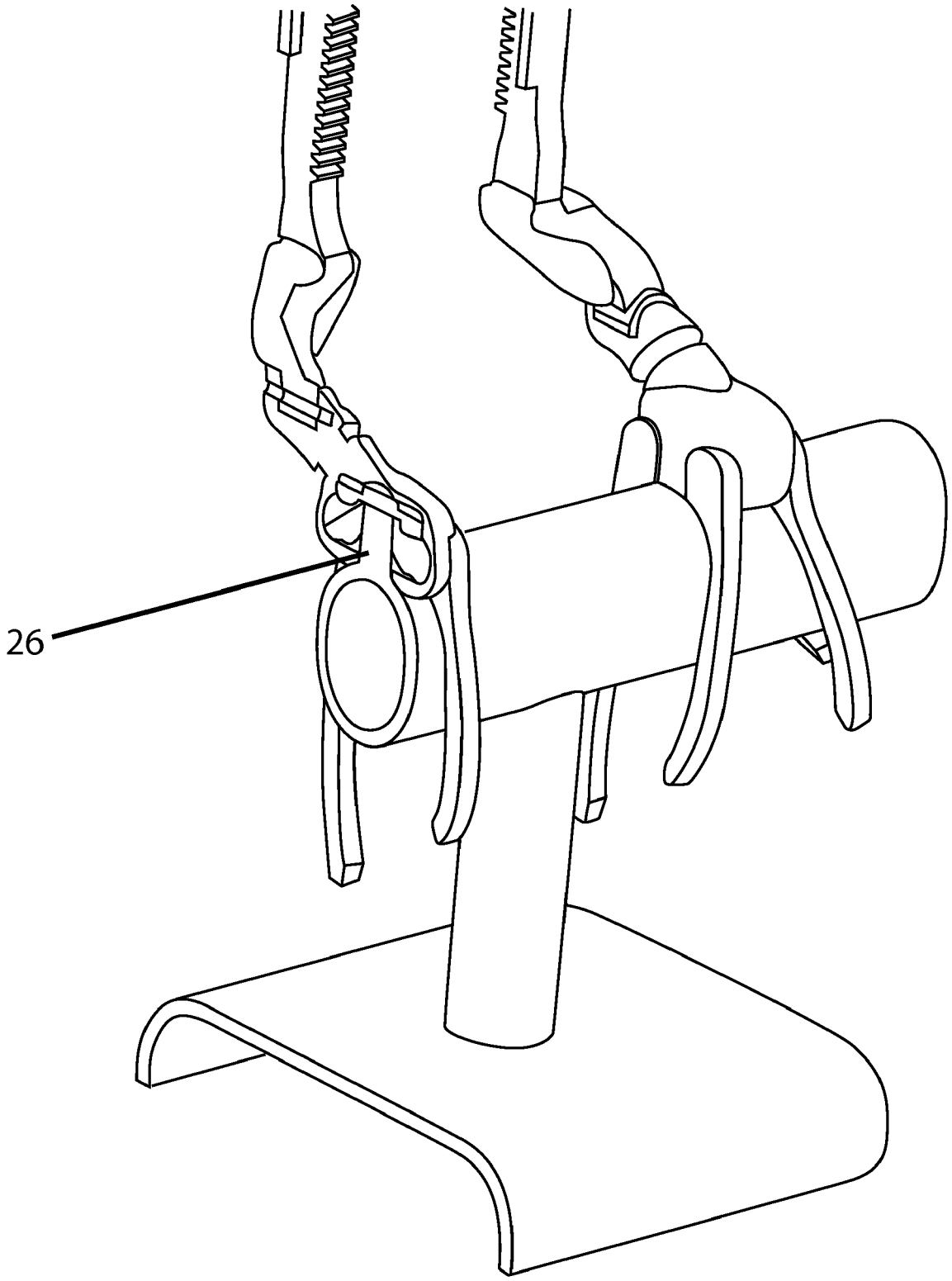
FIG. 3 illustrates of an embodiment of the present invention showing a sectional view of the grasping member of FIG. 2.
Figure 4:
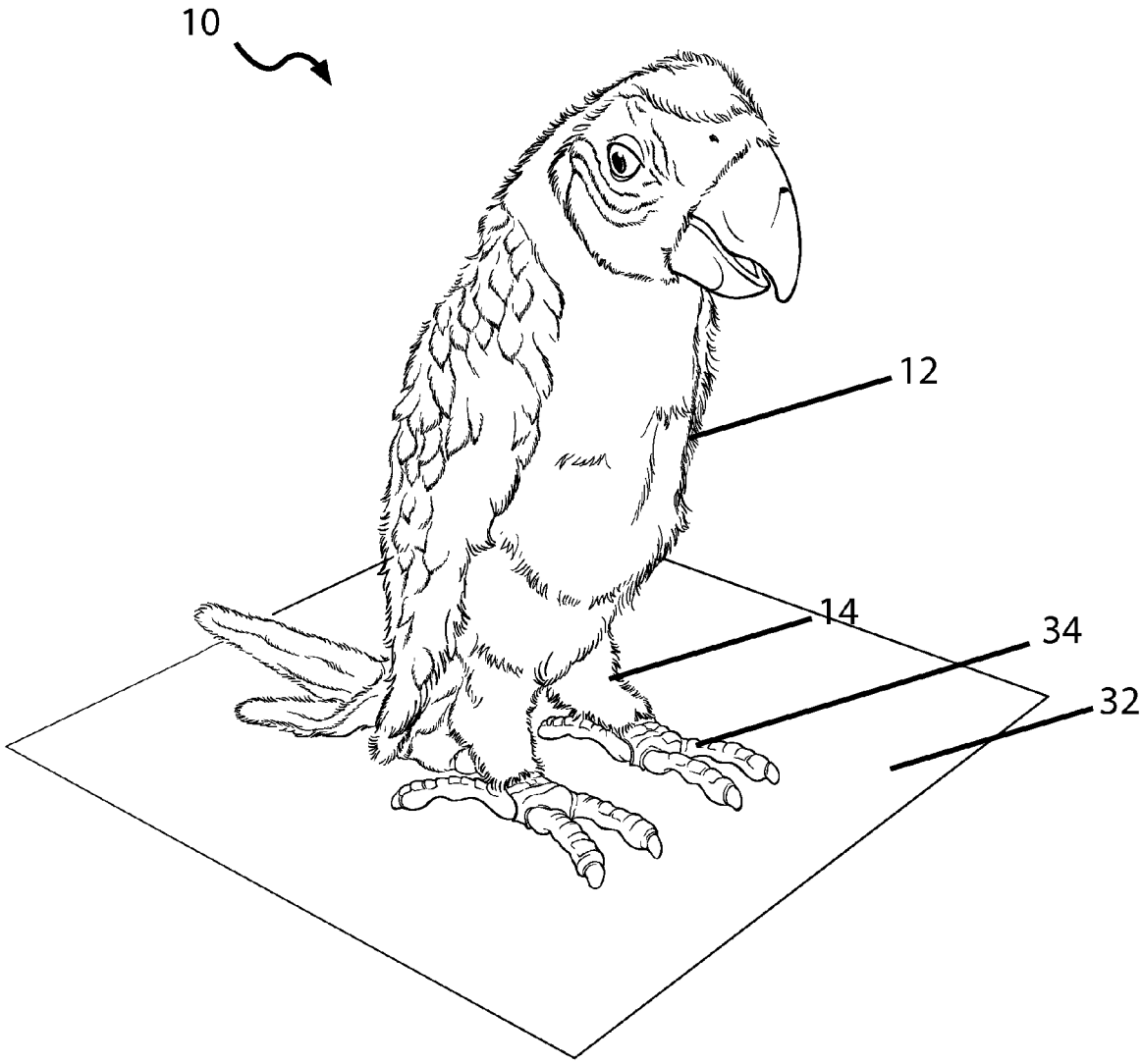
FIG. 4 is a perspective view of the figure illustrating grasping members in their open positions.

In one embodiment, the grasping member 16 mimics a grasping action. The grasping member 16 includes three portions namely a center portion 18, a front portion 20, and a rear portion 22. It is contemplated, however, that an appendage of a different creature or animal embodied by the present invention may contain more or less than three portions, and it is not required that all portions are in contact with the supporting element 28. The front portion 20 is pivotally attached to the center portion 18 allowing reciprocatory movement of the grasping member 16 between a closed position as seen in FIG. 1 and an open position as seen in FIG. 4. A first cam 24 as seen in FIG. 2, is attached to the front portion 20. An aperture element 26 is also included at the center portion 18 for receiving the supporting element 28. The contact of the first cam 24 and the supporting element 28 causes the pivoting of the front portion 20 to its closed position with respect to the supporting element 28.

The rear portion 22 is pivotally attached to the center portion 18 allowing reciprocatory movement of the grasping member 16 between a closed position as seen in FIG. 1 and an open position as seen in FIG. 4. A second cam 30 as seen in FIG. 2 is attached to the rear portion 22. An aperture element 26 is also included at the center portion 18 for receiving the supporting element 28. The contact of the second cam 30 and the supporting element 28 causes the pivoting of the rear portion 22 to its closed position with respect to the supporting element 28. In the present embodiment, the grasping member 16 is included attached to a plurality of appendages 14 as seen in FIGS. 1-6.

Figure 5:
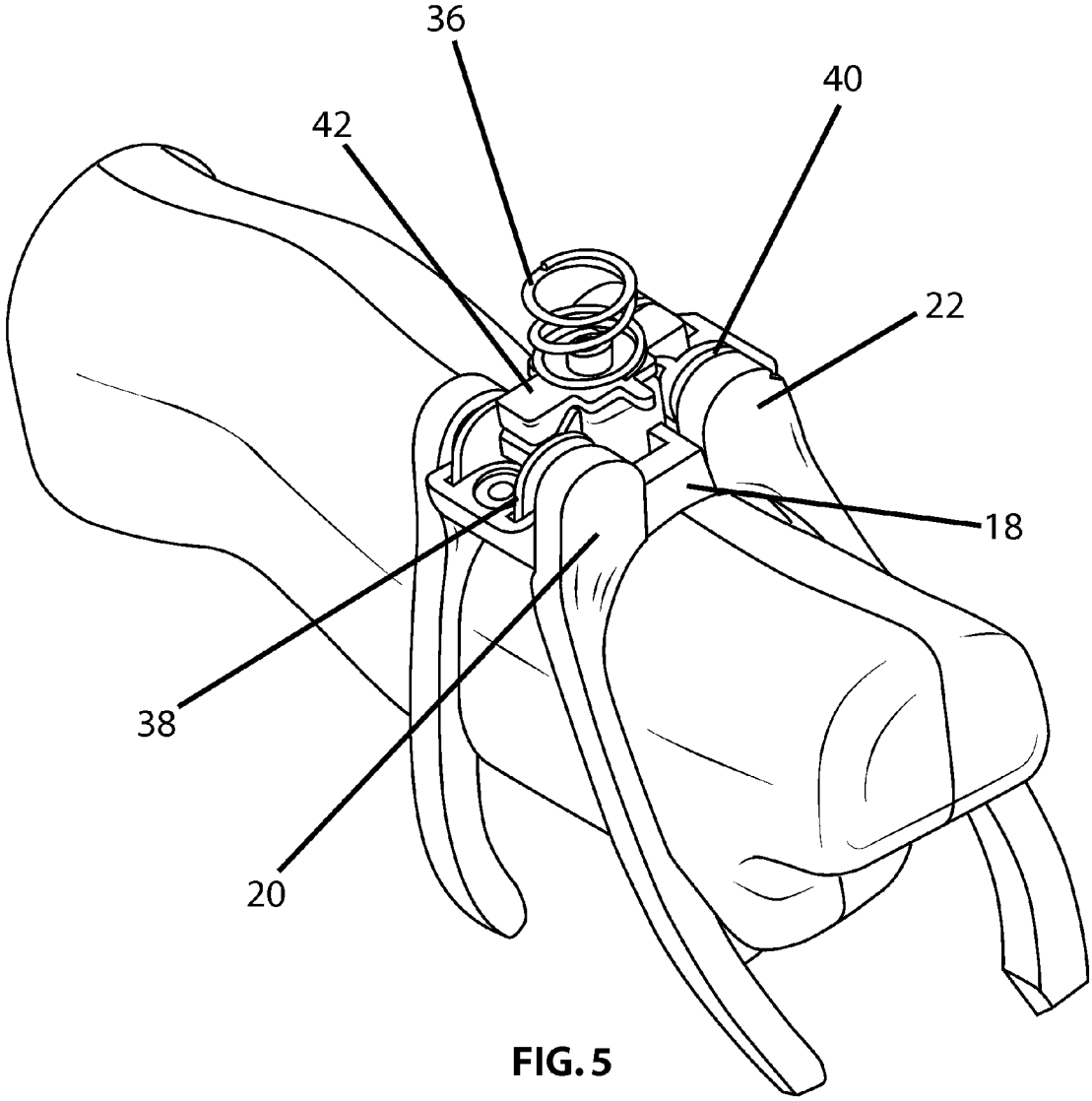
FIG. 5 is a perspective view illustrating a grasping member in the closed position featuring a biased spring loaded plate.
Figure 6:
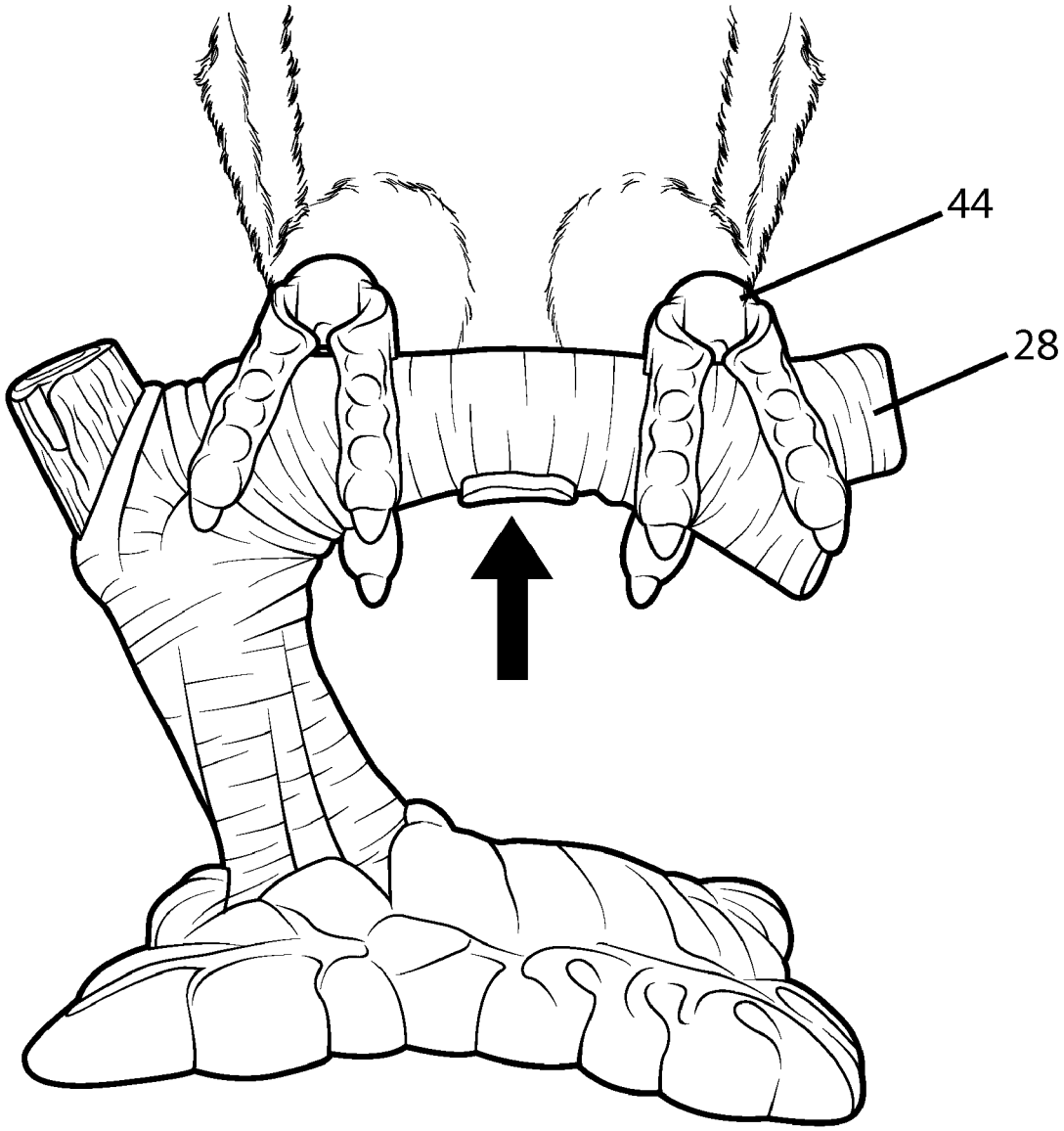
FIG. 6 a view showing the grasping members of the descended appendages perched on a horizontal supporting element.
Figure 7:
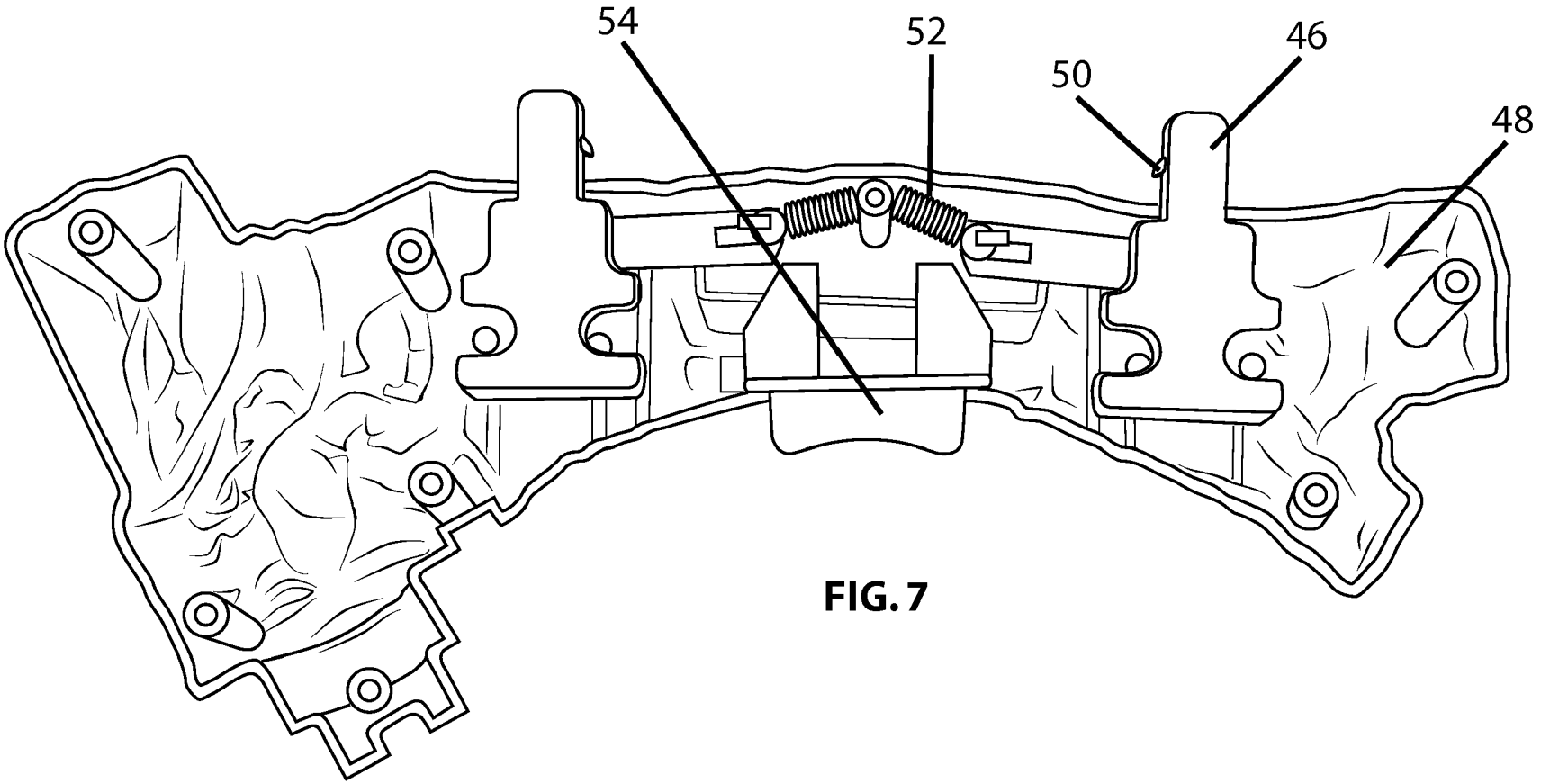
FIG. 7 illustrates a cross-sectional view of the supporting element of FIG. 6.

In an embodiment facilitating further standing modes of operation as illustrated in FIG. 4, the first support member 34 may further mimic a standing action. The first support member 34 in accordance with the described embodiment uses the center portion 18, front portion 20, and rear portion 22 for use in a free standing mode of operation. A biasing element, operating as spring 36 as seen in FIG. 5, is coupled between the front portion 20 and the rear portion 22. The front portion 20 is pivotally attached through a front pivoting connection 38 to the center portion 18 allowing reciprocatory movement of the first support member 34 between a closed position as seen in FIG. 1 and an open position as seen in FIG. 4. The rear portion 22 is pivotally attached through a rear pivoting connection 40 to the center portion 18 allowing reciprocatory movement of the first support member 34 between a closed position as seen in FIG. 1 and an open position as seen in FIG. 4.

In the present embodiment, a plate or cam follower, operating as a biased substantially vertical spring loaded plate 42 as seen in FIG. 5, is connected to spring 36. The first cam 24 is attached to the front portion 20 and operating with vertical spring loaded plate 42 to extend the front portion 20 from the closed position. The second cam 30 is attached to the rear portion 22 and operating with the vertical spring loaded plate 42 to extend the rear portion 22 to the open position from the closed position. The first cam 24 and the second cam 30 are located in the aperture element 26 and pivot to create room for supporting element 28. In turn, the removal of the aperture element 26 causes the first support member 34 to move towards the open position. Furthermore, contact with the horizontal surface 32 will cause the front portion 20 and the rear portion 22 of first support member 34 to pivot to the open position. The front portion 20 and the rear portion 22 pivot towards the closed position when the FIG. 10 is elevated away from the horizontal surface 32, e.g., gravity causes pivoting of front portion 20 and rear portion 22.

In the present embodiment, as seen in FIGS. 1-6, the torso 12 may provide aid in support of the figure through contact with the horizontal surface 32. The FIG. 10 as seen in FIGS. 1-6 may also include a second support member 44. In the present embodiment, the front portion 20 and the rear portion 22 are shaped like an extremity, a talon, and extend outward from the center portion 18.

In the present embodiment the FIG. 10 is supported on supporting element 28, which in the present embodiment resembles a tree branch assembly of a bar or perch, and may be provided as capable of supporting the figure while the grasping member 16 is in the closed position. The supporting element 28, extending from a base, can be assembled from multiple parts.

The supporting element 28 discussed herein includes one or more protrusion portion 46 or posts capable of being received at the grasping member 16 and allowing the grasping member 16 to enter the closed position. A securing device 50, the majority of which is housed within the supporting element 28 is capable of a locking engagement with the center portion 18 of the grasping member 16. The supporting element 28 further includes a biased release element or a release button that may be depressed, operating as compression plate 54 with a substantially horizontal spring 52 in the present embodiment, also housed within the supporting element 28. The compression plate 54 operates with the horizontal spring 52 to manipulate the securing device 50 from a position of a locking engagement with the center portion 18 to a position where the center portion 18 is unlocked. Through force applied onto the compression plate 54 toward the base portion 48, the compression plate 54 extends the horizontal spring 52 and laterally moves the securing device 50. The securing device 50 retreats inside the protrusion portion 46 and is no longer in contact with the center portion 18. Without this contact, the FIG. 10 can be removed from the supporting element 28. Upon release of the compression plate 54, the horizontal spring 52 motivates the securing device 50 laterally, and the securing device 50 is no longer housed inside the protrusion portion 46.

It should be appreciated that a wide range of changes and modifications may be made to the embodiments of the inventions as described herein. It is intended that the foregoing detailed description be regarded as illustrative rather than limiting. While there have been illustrated and described particular embodiments of the inventions, it will be appreciated that numerous changes and modifications will occur to those skilled in the art, and it is intended in the appended claims to cover those changes and modifications which fall within the true spirit and scope of the present invention.

What is claimed is:

1. A mechanism for supporting a figure having a torso and one or more appendages, the mechanism comprising:
- a base;
- a supporting element extending from the base;
- a first grasping member at an end of at least one of the appendages, the first grasping member comprising,
  - a center portion comprising an aperture element for receiving the supporting element,
  - a front portion, and
  - a rear portion;
- a biasing element coupled to the center portion between the front portion and the rear portion;
- a front pivoting connection between the center portion and the front portion;
- a rear pivoting connection between the center portion and the rear portion, each of said front pivoting connection and said rear pivoting connection being pivotally mounted on the center portion to pivot between an opened position and a closed position;
- a plate that is substantially vertically configured and spring loaded by connection with said biasing element; and
- a first cam attached to the front portion and operating with the plate to extend the front portion to the opened position from the closed position, wherein the plate operates as a cam follower in contact with said first cam, causing said front portion to pivot to the closed position upon the aperture element receiving the supporting element thereby causes the front portion of said grasping member to move towards the closed position.

2. A mechanism as recited in claim 1, comprising a second cam attached to said rear portion operating with the plate to extend the rear portion to the opened position from the closed position, wherein the plate operates as a cam follower in contact with said second cam, causing said rear portion to pivot to the closed position upon the aperture element receiving the supporting element thereby causes the rear portion of said grasping member to move towards the closed position.

3. A mechanism as recited in claim 2, wherein removing the supporting element from aperture element causes the front portion and the rear portion of said grasping member to move towards the opened position.

4. A mechanism as recited in claim 2, wherein contact with a surface causes the front portion and the rear portion of said grasping member to move towards the opened position.

5. A mechanism as recited in claim 4, wherein the torso is provided to also contact the surface.

6. A mechanism as recited in claim 2, comprising a second grasping member.

7. A mechanism as recited in claim 2, wherein the front portion and the rear portion of said grasping member at the end of the at least one of the appendages comprise an extremity of a limb of the torso of the figure.

8. A mechanism as recited in claim 6, wherein the supporting element resembles a perch.

9. A mechanism as recited in claim 8, wherein the supporting element resembles a perch, and wherein the front portion and the rear portion of said grasping member are received at the perch.

10. A mechanism for supporting a figure having a torso and one or more appendages, the mechanism comprising:
- a base;
- a supporting element extending from the base;
- a first grasping member at an end of at least one of the appendages, the first grasping member comprising,
  - a center portion comprising an aperture element for receiving the supporting element, and
  - a front portion;
- a front pivoting connection between the center portion and the front portion, said front pivoting connection pivotally mounted on the center portion to pivot the front portion between an opened position and a closed position;
- a biasing element coupled to the center portion;
- a plate that is substantially vertically configured and spring loaded by connection with said biasing element; and
- a first cam attached to the front portion and operating with the plate to extend the front portion to the opened position from the closed position, wherein contact of the first cam with the supporting element pivots the front portion to the closed position.

11. A mechanism as recited in claim 10, wherein the supporting element comprises a perch, and wherein removing the supporting element from aperture element causes the front portion of said grasping member to move towards the opened position.

12. A mechanism as recited in claim 10, wherein contact with a surface causes the front portion of said grasping member to move towards the opened position.

13. A mechanism as recited in claim 10, comprising a second grasping member at an end of another of the appendages wherein the supporting element is a perch and said first and second grasping members at the end of the appendages each comprise an extremity of a limb of the torso of the figure.

14. A mechanism as recited in claim 10, wherein the supporting element comprises a protrusion portion for being received at the aperture element, and a securing device at the protrusion portion of the supporting element for locking engagement with the aperture element.

15. A mechanism as recited in claim 14, wherein the securing device and the protrusion portion of the supporting element extend into the aperture of said center portion.

16. A mechanism as recited in claim 14, wherein the supporting element comprises a release element operable to unlock the aperture element from the securing device.

17. A mechanism as recited in claim 16, wherein said release element comprises a compression plate.

18. A mechanism for supporting a figure having a torso and one or more appendages, the mechanism comprising:
- a base;
- a supporting element extending from the base;
- a first grasping member at an end of at least one of the appendages, said first grasping member comprising a center portion defining an aperture element therein for receiving the supporting element;
- a biasing element coupled to the center portion;
- a front portion pivotally mounted at the center portion to pivot between an opened position and a closed position;
- a plate in mechanical communication with said biasing element; and a first cam operable with the plate to extend the front portion between the opened position and the closed position with contact of the first cam with the supporting element.

19. A mechanism as recited in claim 18, comprising a second cam operable with the plate to extend a rear portion between an opened position and a closed position, wherein the plate operates as a cam follower in contact with said first cam and said second cam when the supporting element is received at the aperture element.

20. A mechanism as recited in claim 18, comprising a second grasping member at an end of another of the appendages wherein the supporting element is a perch and said first and second grasping members at the end of the appendages each comprise an extremity of a limb of the torso of the figure.

* * * * *